US012680416B2

(12) United States Patent
Malone et al.

(10) Patent No.: US 12,680,416 B2
(45) Date of Patent: Jul. 14, 2026

(54) DOWNHOLE TOOL AND METHOD OF USE

(71) Applicant: The WellBoss Company, LLC, Houston, TX (US)

(72) Inventors: Ryan Patrick Malone, Houston, TX (US); Carl Martin, Cypress, TX (US)

(73) Assignee: The WellBoss Company, LLC, Houston, TX (US)

( * ) Notice: Subject to any disclaimer, the term of this patent is extended or adjusted under 35 U.S.C. 154(b) by 0 days.

(21) Appl. No.: 18/776,157

(22) Filed: Jul. 17, 2024

(65) Prior Publication Data

US 2025/0059849 A1 Feb. 20, 2025

Related U.S. Application Data

(60) Provisional application No. 63/533,523, filed on Aug. 18, 2023.

(51) Int. Cl.
*E21B 33/12* (2006.01)
*E21B 33/128* (2006.01)
*E21B 33/129* (2006.01)

(52) U.S. Cl.
CPC ..... *E21B 33/1285* (2013.01); *E21B 33/1208* (2013.01); *E21B 33/129* (2013.01)

(58) Field of Classification Search
CPC . E21B 33/1208; E21B 33/1285; E21B 33/129
See application file for complete search history.

(56) References Cited

U.S. PATENT DOCUMENTS

| | | | | |
|---|---|---|---|---|
| 5,146,992 | A | 9/1992 | Baugh | |
| 5,180,016 | A * | 1/1993 | Ross | E21B 43/10 166/239 |
| 5,607,017 | A | 3/1997 | Owens et al. | |
| 7,350,582 | B2 | 4/2008 | McKeachnie et al. | |
| 8,459,347 | B2 | 6/2013 | Stout | |
| 8,505,632 | B2 | 8/2013 | Guerrero et al. | |
| 8,668,019 | B2 | 3/2014 | Casciaro | |
| 8,839,873 | B2 | 9/2014 | Johnson et al. | |
| 8,991,505 | B2 | 3/2015 | Fleckenstein et al. | |
| 9,033,060 | B2 | 5/2015 | Xu et al. | |
| 9,080,439 | B2 | 7/2015 | O'Malley et al. | |
| 9,428,986 | B2 | 8/2016 | Hern et al. | |
| 9,482,071 | B2 | 11/2016 | Carrejo et al. | |
| 9,512,695 | B2 | 12/2016 | Pabon et al. | |
| 9,556,704 | B2 | 1/2017 | Naedler et al. | |
| 9,574,415 | B2 | 2/2017 | Xu et al. | |
| 9,624,751 | B2 | 4/2017 | Hern et al. | |
| 9,835,003 | B2 | 12/2017 | Harris et al. | |
| 9,976,379 | B2 | 5/2018 | Schmidt et al. | |
| 10,000,991 | B2 | 6/2018 | Harris et al. | |
| 10,066,453 | B2 | 9/2018 | Silva | |
| 10,358,887 | B2 | 7/2019 | Wise et al. | |
| 10,364,629 | B2 | 7/2019 | Jacob et al. | |
| 10,487,625 | B2 | 11/2019 | Jacob | |

(Continued)

*Primary Examiner* — Matthew R Buck
(74) *Attorney, Agent, or Firm* — Kearney, McWilliams & Davis, PLLC; John M. DeBoer

(57) ABSTRACT

A downhole tool suitable for use in a wellbore, the tool having a mandrel with an inner flowbore extending therethrough from a proximate end to a distal end. There is a ball seat in the inner flowbore, and a groove disposed in the inner flowbore in association with the ball seat. A compressible member is disposed in the groove.

20 Claims, 8 Drawing Sheets

(56) References Cited

U.S. PATENT DOCUMENTS

| | | | | |
|---|---|---|---|---|
| 10,533,392 | B2 | 1/2020 | Walton et al. | |
| 10,738,563 | B2 | 8/2020 | Crow et al. | |
| 11,028,666 | B2 * | 6/2021 | Sommers | E21B 33/129 |
| 11,434,717 | B2 | 9/2022 | Jacob | |
| 2004/0163820 | A1 * | 8/2004 | Bishop | E21B 34/142 166/373 |
| 2014/0318816 | A1 * | 10/2014 | Hofman | E21B 34/14 166/194 |
| 2016/0040492 | A1 | 2/2016 | Vinson et al. | |
| 2016/0186511 | A1 | 6/2016 | Coronado et al. | |
| 2018/0148993 | A1 * | 5/2018 | Schmidt | E21B 33/1291 |
| 2018/0163492 | A1 * | 6/2018 | Kellner | E21B 33/129 |
| 2019/0203557 | A1 * | 7/2019 | Dirocco | E21B 33/129 |
| 2021/0115752 | A1 * | 4/2021 | Slup | E21B 23/00 |
| 2021/0277741 | A1 | 9/2021 | Xue et al. | |

* cited by examiner

DOWNHOLE TOOL AND METHOD OF USE

STATEMENT REGARDING FEDERALLY SPONSORED RESEARCH OR DEVELOPMENT

Not applicable.

BACKGROUND

Field of the Disclosure

This disclosure generally relates to downhole tools and related systems and methods used in oil and gas wellbores. More specifically, the disclosure relates to a downhole system and tool that may be run into a wellbore and useable for wellbore isolation, and methods pertaining to the same. In particular embodiments, the downhole tool may be a plug made of drillable or dissolvable materials. In other embodiments, the downhole tool may have a ball seat configured for enhanced or improved sealing with a ball.

Background of the Disclosure

An oil or gas well includes a wellbore extending into a subterranean formation at some depth below a surface (e.g., Earth's surface), and is usually lined with a tubular, such as casing, to add strength to the well. Many commercially viable hydrocarbon sources are found in "tight" reservoirs, which means the target hydrocarbon product may not be easily extracted. The surrounding formation (e.g., shale) to these reservoirs typically has low permeability, and it is uneconomical to produce the hydrocarbons (i.e., gas, oil, etc.) in commercial quantities from this formation without the use of drilling accompanied with fracing operations.

Fracing now has a significant presence in the industry, and is commonly understood to include the use of some type of plug set in the wellbore below or beyond the respective target zone, followed by pumping or injecting high pressure frac fluid into the zone. For economic reasons, fracing (and any associated or peripheral operation) is now ultra-competitive, and in order to stay competitive innovation is paramount. A frac plug and accompanying operation may be such as described or otherwise disclosed in U.S. Pat. No. 8,955,605, incorporated by reference herein in its entirety for all purposes.

FIG. 1 illustrates a conventional plugging system 100 that includes use of a downhole tool 102 used for plugging a section of the wellbore 106 drilled into formation 110. The tool or plug 102 may be lowered into the wellbore 106 by way of workstring 112 (e.g., e-line, wireline, coiled tubing, etc.) and/or with setting tool 117, as applicable. The tool 102 generally includes a body 103 with a compressible seal member 122 to seal the tool 102 against an inner surface 107 of a surrounding tubular, such as casing 108. The tool 102 may include the seal member 122 disposed between one or more slips 109, 111 that are used to help retain the tool 102 in place.

In operation, forces (usually axial relative to the wellbore 106) are applied to the slip(s) 109, 111 and the body 103. As the setting sequence progresses, slip 109 moves in relation to the body 103 and slip 111, the seal member 122 is actuated, and the slips 109, 111 are driven against corresponding conical surfaces 104. This movement axially compresses and/or radially expands the compressible member 122, and the slips 109, 111, which results in these components being urged outward from the tool 102 to contact the inner wall 107. In this manner, the tool 102 provides a seal expected to prevent transfer of fluids from one section 113 of the wellbore across or through the tool 102 to another section 115 (or vice versa, etc.), or to the surface. Tool 102 may also include an interior passage (not shown) that allows fluid communication between section 113 and section 115 when desired by the user. Oftentimes multiple sections are isolated by way of one or more additional plugs (e.g., 102A).

The setting tool 117 is incorporated into the workstring 112 along with the downhole tool 102. Examples of commercial setting tools include the Baker #10 and #20, and the 'Owens Go'. Upon proper setting, the plug may be subjected to high or extreme pressure and temperature conditions, which means the plug must be capable of withstanding these conditions without destruction of the plug or the seal formed by the seal element. High temperatures are generally defined as downhole temperatures above 200° F., and high pressures are generally defined as downhole pressures above 7,500 psi, and even in excess of 15,000 psi. Extreme wellbore conditions may also include high and low pH environments. In these conditions, conventional tools, including those with compressible seal elements, may become ineffective from degradation. For example, the scaling element may melt, solidify, or otherwise lose elasticity, resulting in a loss the ability to form a seal barrier.

Because plugs are required to withstand extreme downhole conditions, they are built for durability and toughness, which often makes the drill-through process difficult, time-consuming, and/or require considerable expertise. Even drillable plugs are typically constructed of a metal such as cast iron that may be drilled out with a drill bit at the end of a drill string. Steel may also be used in the structural body of the plug to provide structural strength to set the tool. The more metal parts used in the tool, the longer the drilling operation takes. Because metallic components are harder to drill through, this process may require additional trips into and out of the wellbore to replace worn out drill bits.

Composite materials, such as filament wound materials, have enjoyed success in the frac industry because of easy-to-drill tendencies. The process of making filament wound materials is known in the art, and although subject to differences, typically entails a known process. However, even composite plugs require drilling, or often have one or more pieces of metal (sometimes hardened metal).

In the interest of cost-saving, materials that react under certain downhole conditions have been the subject of significant research in view of the potential offered to the oilfield industry. For example, such an advanced material that has an ability to degrade by mere response to a change in its surrounding is desirable because no, or limited, intervention would be necessary for removal or actuation to occur.

Such a material, essentially self-actuated by changes in its surrounding (e.g., the presence a specific fluid, a change in temperature, and/or a change in pressure, etc.) may potentially replace costly and complicated designs and may be most advantageous in situations where accessibility is limited or even considered to be impossible, which is the case in a downhole (subterranean) environment. However, these materials tend to be exotic, rendering related tools made of such materials undesirable as a result of high cost.

Dissolvable tools (or components thereof) also begin to lose material from all exposed surface areas (dissolve) as soon as they are in contact with the wellbore fluid, and this process is sped up exponentially by increases in temperature and the chloride composition of the fluid.

As a result of this, the metal-to-metal seal required for the frac ball to seal off on the ball seat may corrode to the point that it is impossible to create a pressure tight seal on the plug. This can result in observable casing pressure losses at surface and as the leak rate increases, it could reduce the efficacy of the frac stage being performed.

The ability to save cost on materials and/or operational time (and those saving operational costs) leads to considerable competition in the marketplace. Achieving any ability to save time, or ultimately cost, leads to an immediate competitive advantage.

Accordingly, there are needs in the art for novel systems and methods for isolating wellbores in a fast, viable, and economical fashion. There is a great need in the art for downhole plugging tools that form a reliable and resilient seal against a surrounding tubular that use less materials, less parts, have reduced or eliminated removal time, and are easier to deploy, even in the presence of extreme wellbore conditions. There is also a need for a downhole tool made substantially of a drillable material that is easier and faster to drill, or outright eliminates a need for drill-thru. The ability to form a reliable seal between a plug (ball) and (ball) seat, even under dissolving conditions is of paramount necessity.

SUMMARY

Embodiments of the disclosure pertain to a downhole tool for use in a wellbore that may include any of the following: a mandrel comprising: a distal end; a proximate end; and an outer surface.

The mandrel may include a ball seat formed within an inner flowbore. The ball seat may have a transition portion that includes a curvilinear portion, a linear portion, and combinations thereof.

The downhole tool may have other components, such as a slip, a composite member, a cone, a seal element, a lower sleeve, etc. The lower sleeve may be coupled with the slip.

The transition portion may result in a first inner diameter of a first portion of the inner flowbore increased to a second inner diameter of a second portion of the inner flowbore, The ball seat, the first portion or the second portion of the inner flowbore may have a groove configured with a compressible member disposed therein.

The first inner diameter may be smaller than the second inner diameter. The first inner diameter of the first portion between a lower end of the ball seat and the distal end may be constant.

In aspects, any component of the downhole tool may be made of a reactive (e.g., dissolvable) metal-based material.

The lower sleeve may have a shear member engaged with the slip in an unset position. A longitudinal length of the downhole tool after being moved to a set position may be in a set length range of at least 5 inches to no more than 15 inches. In the set position, the shear member may be sheared.

Other embodiments of the disclosure pertain to a downhole tool that may have any of: a mandrel; a composite member; a slip; and a lower sleeve coupled with the slip.

The mandrel may include a distal end; a proximate end; an outer surface; an inner flowbore extending through the cone mandrel from the proximate end to the distal end; and a ball seat in the inner flowbore.

The inner flowbore may include a groove configured with a compressible member disposed therein. The groove may be disposed in the vicinity of the ball seat or in the ball seat. Any component of the downhole tool may be made of a reactive (dissolvable) metal-based material. The outer surface of the mandrel may be void of threads.

A compressible member such as an O-ring may be disposed in a ball seat groove. For at least a portion of time during a pressurization sequence, the compressible member engages a ball as it seats thereagainst.

The mandrel may be a cone mandrel of dual-frustoconical in shape. As such, the outer surface may include a first angled surface and a second angled surface. The first angled surface may include a first plane that in cross section bisects a longitudinal axis a first angle. The second angled surface may be negative to the first angled surface. In aspects, the second angled surface may include a second plane that in cross section bisects the longitudinal angle negative to that of the first angle.

The slip may include an at least one slip groove that forms a lateral opening in the slip. The slip groove may be defined by a first portion of slip material at a first slip end, a second portion of slip material at a second slip end. The slip groove may have a depth that extends from a slip outer surface to a slip inner surface.

Any component of the downhole tool may be made of a composite material. Any component of the downhole tool is made of a dissolvable material. The dissolvable material may be composite- or metal-based. The inner flowbore may have an inner diameter in a bore range of about 1 inch to 5 inches.

Other embodiments of the disclosure pertain to a downhole setting system for use in a wellbore that may include a workstring; a setting tool assembly coupled to the workstring; and a downhole tool coupled with the setting tool assembly.

These and other embodiments, features and advantages will be apparent in the following detailed description and drawings.

BRIEF DESCRIPTION OF THE DRAWINGS

A full understanding of embodiments disclosed herein is obtained from the detailed description of the disclosure presented herein below, and the accompanying drawings, which are given by way of illustration only and are not intended to be limitative of the present embodiments, and wherein.

DETAILED DESCRIPTION

Figure 1:
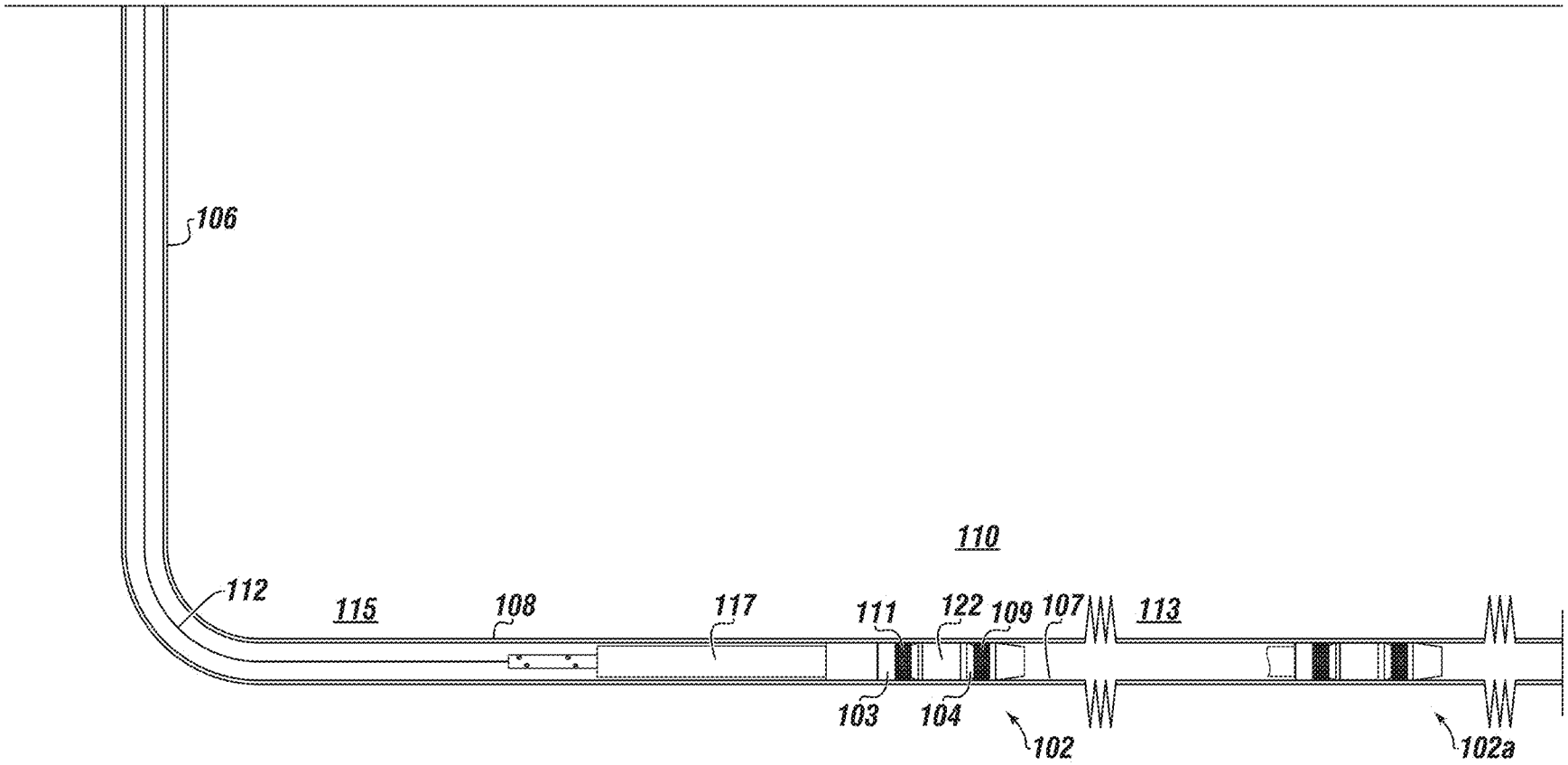
FIGURE 1 (PRIOR ART)
FIG. 1 is a side view of a process diagram of a conventional plugging system.

Herein disclosed are novel apparatuses, systems, and methods that pertain to and are usable for wellbore operations, details of which are described herein.

Embodiments of the present disclosure are described in detail in a non-limiting manner with reference to the accompanying Figures. In the following discussion and in the claims, the terms "including" and "comprising" are used in an open-ended fashion, such as to mean, for example, "including, but not limited to . . . ". While the disclosure may be described with reference to relevant apparatuses, systems, and methods, it should be understood that the disclosure is not limited to the specific embodiments shown or described. Rather, one skilled in the art will appreciate that a variety of configurations may be implemented in accordance with embodiments herein.

Although not necessary, like elements in the various figures may be denoted by like reference numerals for consistency and ease of understanding. Numerous specific details are set forth in order to provide a more thorough understanding of the disclosure; however, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," "right", "left", "down", etc., are used for convenience and to refer to general direction and/or orientation, and are only intended for illustrative purposes only, and not to limit the disclosure.

Connection(s), couplings, or other forms of contact between parts, components, and so forth may include conventional items, such as lubricant, additional sealing materials, such as a gasket between flanges, PTFE between threads, and the like. The make and manufacture of any particular component, subcomponent, etc., may be as would be apparent to one of skill in the art, such as molding, forming, press extrusion, machining, or additive manufacturing. Embodiments of the disclosure provide for one or more components that may be new, used, and/or retrofitted.

Various equipment may be in fluid communication directly or indirectly with other equipment. Fluid communication may occur via one or more transfer lines and respective connectors, couplings, valving, and so forth. Fluid movers, such as pumps, may be utilized as would be apparent to one of skill in the art.

Numerical ranges in this disclosure may be approximate, and thus may include values outside of the range unless otherwise indicated. Numerical ranges include all values from and including the expressed lower and the upper values, in increments of smaller units. As an example, if a compositional, physical or other property, such as, for example, molecular weight, viscosity, temperature, pressure, distance, melt index, etc., is from 100 to 1,000, it is intended that all individual values, such as 100, 101, 102, etc., and sub ranges, such as 100 to 144, 155 to 170, 197 to 200, etc., are expressly enumerated. It is intended that decimals or fractions thereof be included. For ranges containing values which are less than one or containing fractional numbers greater than one (e.g., 1.1, 1.5, etc.), smaller units may be considered to be 0.0001, 0.001, 0.01, 0.1, etc. as appropriate. These are only examples of what is specifically intended, and all possible combinations of numerical values between the lowest value and the highest value enumerated, are to be considered to be expressly stated in this disclosure. Others may be implied or inferred.

Embodiments herein may be described at the macro level, especially from an ornamental or visual appearance. Thus, a dimension, such as length, may be described as having a certain numerical unit, albeit with or without attribution of a particular significant figure. One of skill in the art would appreciate that the dimension of "2 centimeters" may not be exactly 2 centimeters, and that at the micro-level may deviate. Similarly, reference to a "uniform" dimension, such as thickness, need not refer to completely, exactly uniform. Thus, a uniform or equal thickness of "1 millimeter" may have discernable variation at the micro-level within a certain tolerance (e.g., 0.001 millimeter) related to imprecision in measuring and fabrication.

Terms

The term "connected" as used herein may refer to a connection between a respective component (or subcomponent) and another component (or another subcomponent), which can be fixed, movable, direct, indirect, and analogous to engaged, coupled, disposed, etc., and can be by screw, nut/bolt, weld, and so forth. Any use of any form of the terms "connect", "engage", "couple", "attach", "mount", etc. or any other term describing an interaction between elements is not meant to limit the interaction to direct interaction between the elements and may also include indirect interaction between the elements described.

The term "fluid" as used herein may refer to a liquid, gas, slurry, multi-phase, etc. and is not limited to any particular type of fluid such as hydrocarbons.

The term "fluid connection", "fluid communication," "fluidly communicable," and the like, as used herein may refer to two or more components, systems, etc. being coupled whereby fluid from one may flow or otherwise be transferrable to the other. The coupling may be direct or indirect. For example, valves, flow meters, pumps, mixing tanks, holding tanks, tubulars, separation systems, and the like may be disposed between two or more components that are in fluid communication.

The term "pipe", "conduit", "line", "tubular", or the like as used herein may refer to any fluid transmission means, and may be tubular in nature.

The term "composition" or "composition of matter" as used herein may refer to one or more ingredients, components, constituents, etc. that make up a material (or material of construction). Composition may refer to a flow stream, or the material of construction of a component of a downhole tool, of one or more chemical components.

The term "chemical" as used herein may analogously mean or be interchangeable to material, chemical material, ingredient, component, chemical component, element, substance, compound, chemical compound, molecule(s), constituent, and so forth and vice versa. Any 'chemical' discussed in the present disclosure need not refer to a 100% pure chemical. For example, although 'water' may be thought of as H2O, one of skill would appreciate various ions, salts, minerals, impurities, and other substances (including at the ppb level) may be present in 'water'. A chemical may include all isomeric forms and vice versa (for example, "hexane", includes all isomers of hexane individually or collectively).

The term "pump" as used herein may refer to a mechanical device suitable to use an action such as suction or pressure to raise or move liquids, compress gases, and so forth. 'Pump' can further refer to or include all necessary subcomponents operable together, such as impeller (or vanes, etc.), housing, drive shaft, bearings, etc. Although not always the case, 'pump' can further include reference to a driver, such as an engine and drive shaft. Types of pumps include gas powered, hydraulic, pneumatic, and electrical.

The term "frac operation" as used herein may refer to fractionation of a downhole well that has already been drilled. 'Frac operation' can also be referred to and interchangeable with the terms fractionation, hydrofracturing, hydrofracking, fracking, fracing, frac, and the like. A frac operation can be land or water based.

The term "mounted" as used herein may refer to a connection between a respective component (or subcomponent) and another component (or another subcomponent), which can be fixed, movable, direct, indirect, and analogous to engaged, coupled, disposed, etc., and can be by screw, nut/bolt, weld, and so forth.

The term "reactive material" as used herein may refer a material with a composition of matter having properties and/or characteristics that result in the material responding to a change over time and/or under certain conditions. The term reactive material may encompass degradable, dissolvable, disassociatable, dissociable, and so on.

The term "degradable material" as used herein may refer to a composition of matter having properties and/or characteristics that, while subject to change over time and/or under certain conditions, lead to a change in the integrity of the material. As one example, the material may initially be hard, rigid, and strong at ambient or surface conditions, but over time (such as within about 12-36 hours) and under certain conditions (such as wellbore conditions), the material softens.

The term "dissolvable material" may be analogous to degradable material. The term as used herein may refer to a composition of matter having properties and/or characteristics that, while subject to change over time and/or under certain conditions, lead to a change in the integrity of the material, including to the point of degrading, or partial or complete dissolution. As one example, the material may initially be hard, rigid, and strong at ambient or surface conditions, but over time (such as within about 12-36 hours) and under certain conditions (such as wellbore conditions), the material softens. As another example, the material may initially be hard, rigid, and strong at ambient or surface conditions, but over time (such as within about 12-36 hours) and under certain conditions (such as wellbore conditions), the material dissolves at least partially, and may dissolve completely. The material may dissolve via one or more mechanisms, such as oxidation, reduction, deterioration, go into solution, or otherwise lose sufficient mass and structural integrity.

The term "breakable material" as used herein may refer to a composition of matter having properties and/or characteristics that, while subject to change over time and/or under certain conditions, lead to brittleness. As one example, the material may be hard, rigid, and strong at ambient or surface conditions, but over time and under certain conditions, becomes brittle. The breakable material may experience breakage into multiple pieces, but not necessarily dissolution.

For some embodiments, a material of construction may include a composition of matter designed or otherwise having the inherent characteristic to react or change integrity or other physical attribute when exposed to certain wellbore conditions, such as a change in time, temperature, water, heat, pressure, solution, combinations thereof, etc. Heat may be present due to the temperature increase attributed to the natural temperature gradient of the earth, and water may already be present in existing wellbore fluids. The change in integrity may occur in a predetermined time period, which may vary from several minutes to several weeks. In aspects, the time period may be about 12 to about 36 hours.

The term "machined" can refer to a computer numerical control (CNC) process whereby a robot or machinist runs computer-operated equipment to create machine parts, tools and the like.

The term "plane" or "planar" as used herein may refer to any surface or shape that is flat, at least in cross-section. For example, a frusto-conical surface may appear to be planar in 2D cross-section. It should be understood that plane or planar need not refer to exact mathematical precision, but instead be contemplated as visual appearance to the naked eye. A plane or planar may be illustrated in 2D by way of a line.

The term "parallel" as used herein may refer to any surface or shape that may have a reference plane lying in the same direction or vector as that of another. It should be understood that parallel need not refer to exact mathematical precision, but instead be contemplated as visual appearance to the naked eye.

The term "cone mandrel" as used herein may refer to a tubular component having an at least one generally frusto-conical surface. The cone mandrel may have an external surface that in cross section has a reference line/plane bisecting a reference axis at an angle. The cone mandrel may be a dual (also "dual faced", "double faced, and the like) cone, meaning there may be a second external surface having a second reference line/plane bisecting the reference axis (in cross-section) at a second angle. The second angle may be negative to the first angle (e.g., +10 degrees for the first, −10 degrees for the second).

Figures 2A, 2B:
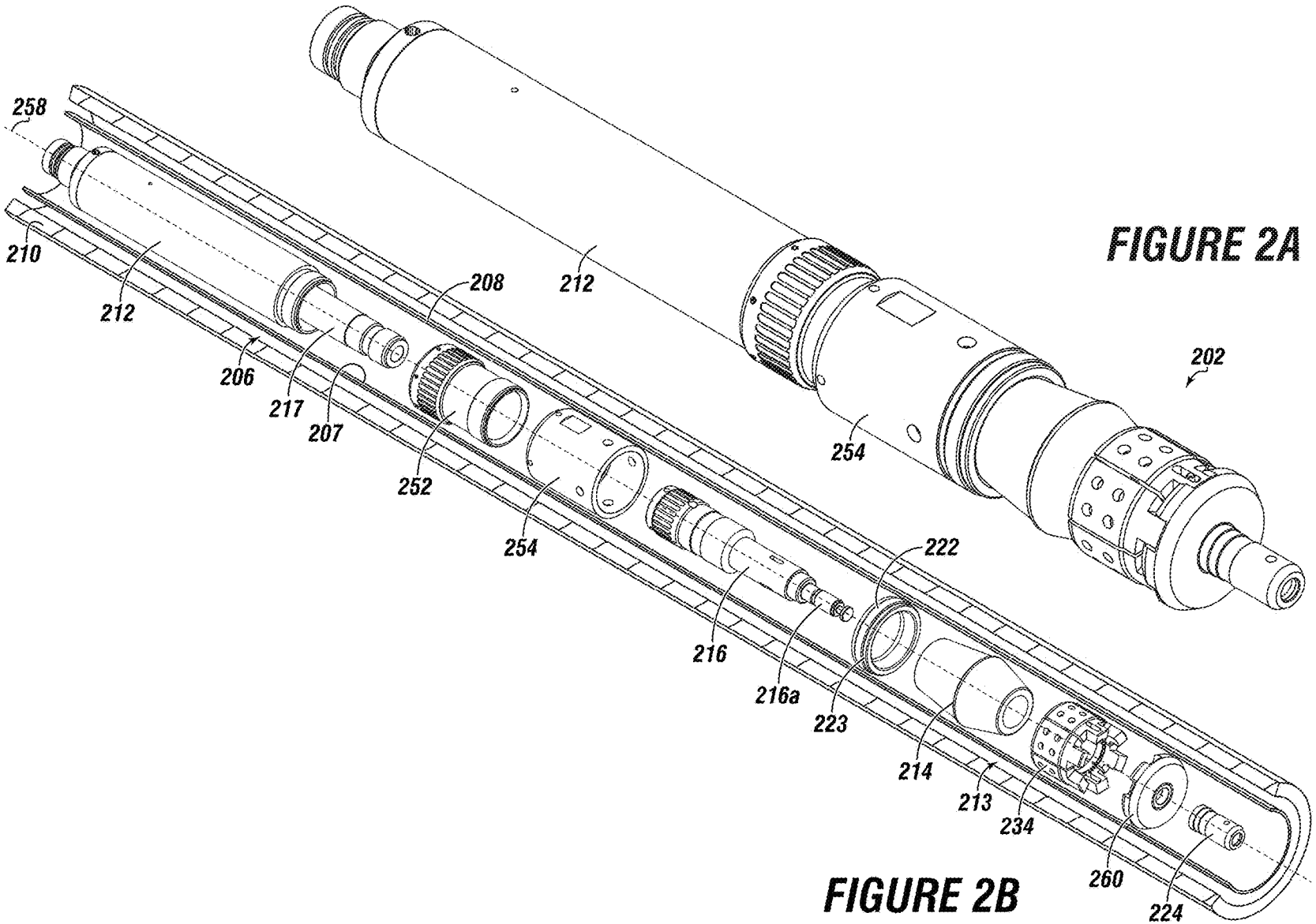
FIG. 2A shows an isometric view of a system having a downhole tool, according to embodiments of the disclosure.
FIG. 2B shows an isometric breakout view of a system having a downhole tool, according to embodiments of the disclosure.

Referring now to FIGS. 2A and 2B together, isometric views of a system 200 having a downhole tool 202 illustrative of embodiments disclosed herein, are shown. FIG. 2B depicts a wellbore 206 formed in a subterranean formation 210 with a tubular 208 disposed therein. In an embodiment, the tubular 208 may be casing (e.g., casing, hung casing, casing string, etc.) (which may be cemented), and the like.

A workstring 212 (which may include a setting tool [or a part 217 of a setting tool] configured with an adapter 252) may be used to position or run the downhole tool 202 into and through the wellbore 206 to a desired location. One of skill would appreciate the setting tool may be like that provided by Baker or Owen. The setting tool assembly 217 may include or be associated with a setting sleeve 254. The setting sleeve 254 may be engaged with the downhole tool (or a component thereof) 202.

The setting tool may include a tension mandrel 216 associated (e.g., coupled) with an adapter 252. In an embodiment, the adapter 252 may be coupled with the setting tool (or part thereof) 217, and the tension mandrel 216 may be coupled with the adapter 252. The coupling may be a threaded connection (such as via threads on the adapter 252 and corresponding threads of the tension mandrel 216—not shown here). The tension mandrel 216 may extend, at least partially, out of the (bottom/downhole/distal end) tool 202.

An end or extension 216*a* of the tension mandrel 216 may be coupled with a nose sleeve or nut 224. The nut 224 may have a threaded connection 225 with the end 216*a* (and thus corresponding mating threads), although other forms of coupling may be possible. For additional securing, one or more set screws 226 may be disposed through set screw holes 227 and screwed into or tightened against the end 216*a*. The nut 224 may engage or abut against a shear tab of a lower sleeve 260.

The downhole tool 202, as well as its components, may be annular in nature, and thus centrally disposed or arranged with respect to a longitudinal axis 258. In accordance with embodiments of the disclosure, the tool 202 may be configured as a plugging tool, which may be set within the tubular 208 in such a manner that the tool 202 forms a fluid-tight seal against the inner surface 207 of the tubular 208. The seal may be facilitated by a seal element 222 expanded into a sealing position against the inner surface 207. The seal element 222 may be supported by a carrier ring 223. The carrier ring 223 may be disposed around a cone mandrel 214. Once set, the downhole tool 202 may be held in place by use of an at least one slip 234. The slip 234 may have a one-piece configuration.

In an embodiment, the downhole tool 202 may be configured as a bridge plug, whereby flow from one section of the wellbore to another (e.g., above and below the tool 202) is controlled. In other embodiments, the downhole tool 202 may be configured as a frac plug, where flow into one section 213 of the wellbore 206 may be blocked and otherwise diverted into the surrounding formation or reservoir 210.

In yet other embodiments, the downhole tool 202 may also be configured as a ball drop tool. In this aspect, a ball (e.g., 285, FIG. 2E) may be dropped into the wellbore 206 and flowed into the tool 202 and come to rest in a corresponding ball seat (286) at the end of the cone mandrel 214. The seating of the ball may provide a seal within the tool 202 resulting in a plugged condition, whereby a pressure differential across the tool 202 may result. The ball seat may include a radius or curvature. The radius or curvature may be convex or concave in nature. Although not shown here, the seat 286 may have a groove (or also ball seat groove), which may have a compressible member therein (see, e.g., FIG. 5C). Thus, the seat 286 (and ball 285) may interact like that of any described herein.

In other embodiments, the downhole tool 202 may be a ball check plug, whereby the tool 202 is configured with a ball already in place when the tool 202 runs into the wellbore. The tool 202 may then act as a check valve, and provide one-way flow capability. Fluid may be directed from the wellbore 206 to the formation 210 with any of these configurations.

Once the tool 202 reaches the set position within the tubular, the setting mechanism or workstring 212 may be detached from the tool 202 by various methods, resulting in the tool 202 left in the surrounding tubular 208 and one or more sections (e.g., 213) of the wellbore 206 isolated. In an embodiment, once the tool 202 is set, tension may be applied to the setting tool (217) until a shearable connection between the tool 202 and the workstring 212 is broken. However, the downhole tool 202 may have other forms of disconnect. The amount of load applied to the setting tool and the shearable connection may be in the range of about, for example, 20,000 to 55,000 pounds force.

In embodiments the tension mandrel 216 may separate or detach from a lower sleeve 260 (directly or indirectly), resulting in the workstring 212 being able to separate from the tool 202, which may be at a predetermined moment. The loads provided herein are non-limiting and are merely exemplary. The setting force may be determined by specifically designing the interacting surfaces of the tool 202 and the respective tool surface angles. The tool 202 may also be configured with a predetermined failure point (not shown) configured to fail, break, or otherwise induce fracture. For example, the lower sleeve 260 may be configured with a groove having an association with the shearable connection or tab, the groove being suitable to induce proximate fracture.

Operation of the downhole tool 202 may allow for fast run in of the tool 202 to isolate one or more sections of the wellbore 206, as well as quick and simple drill-through or dissolution to destroy or remove the tool 202.

Accordingly, in some embodiments, drill-through may be completely unnecessary. As such the downhole tool 202 may have one or more components made of a reactive material, such as a metal or metal alloys. The downhole tool 202 may have one or more components made of a reactive material (e.g., dissolvable, degradable, etc.), which may be composite- or metal-based.

It follows then that one or more components of a tool of embodiments disclosed herein may be made of reactive materials (e.g., materials suitable for and are known to dissolve, degrade, etc. in downhole environments [including extreme pressure, temperature, fluid properties, etc.] after a brief or limited period of time (predetermined or otherwise) as may be desired). In an embodiment, a component made of a reactive material may begin to react within about 3 to about 48 hours after setting of the downhole tool 202.

In embodiments, one or more components may be made of a metallic material, such as an aluminum-based or magnesium-based material. The metallic material may be reactive, such as dissolvable, which is to say under certain conditions the respective component(s) may begin to dissolve, and thus alleviating the need for drill thru. These conditions may be anticipated and thus predetermined. In embodiments, the components of the tool 202 may be made of dissolvable aluminum-, magnesium-, or aluminum-magnesium-based (or alloy, complex, etc.) material, such as that provided by Nanjing Highsur Composite Materials Technology Co. LTD or Terves, Inc.

One or more components of tool 202 may be made of non-dissolvable materials (e.g., materials suitable for and are known to withstand downhole environments [including extreme pressure, temperature, fluid properties, etc.] for an extended period of time (predetermined or otherwise) as may be desired).

The downhole tool 202 (and other tool embodiments disclosed herein) and/or one or more of its components may be 3D-printed or made with other forms of additive manufacturing.

Figure 2C:
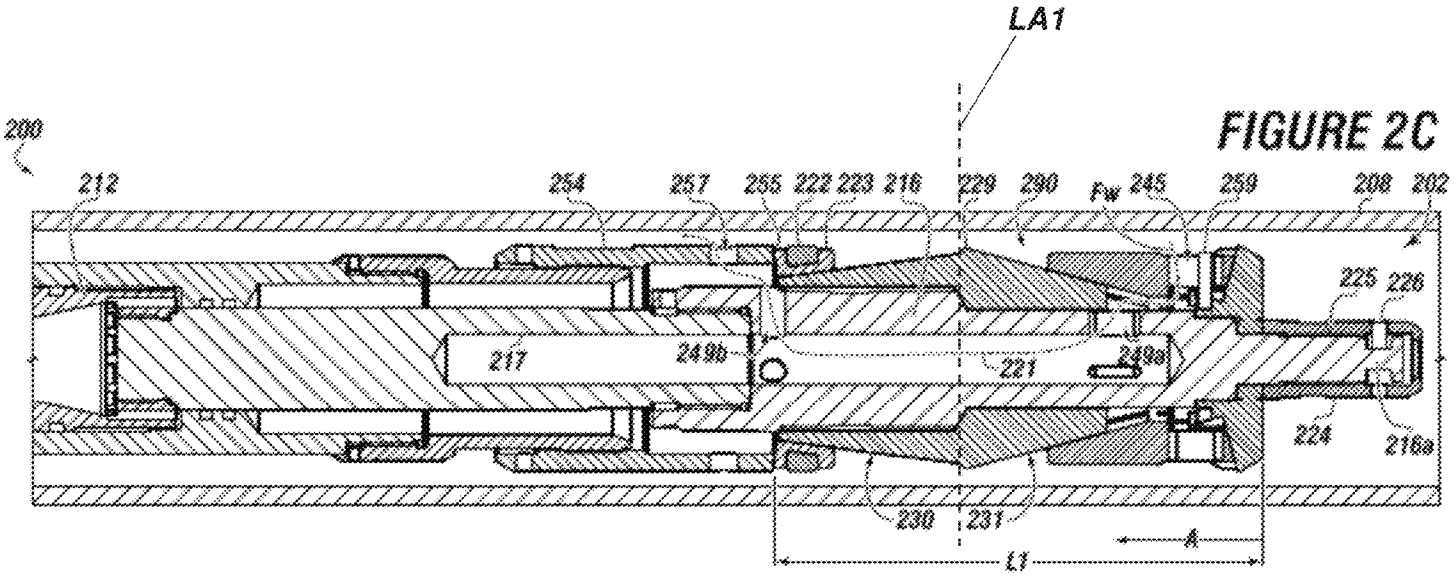
FIG. 2C shows a longitudinal side cross-sectional view of an unset downhole tool according to embodiments of the disclosure.
Figure 2D:
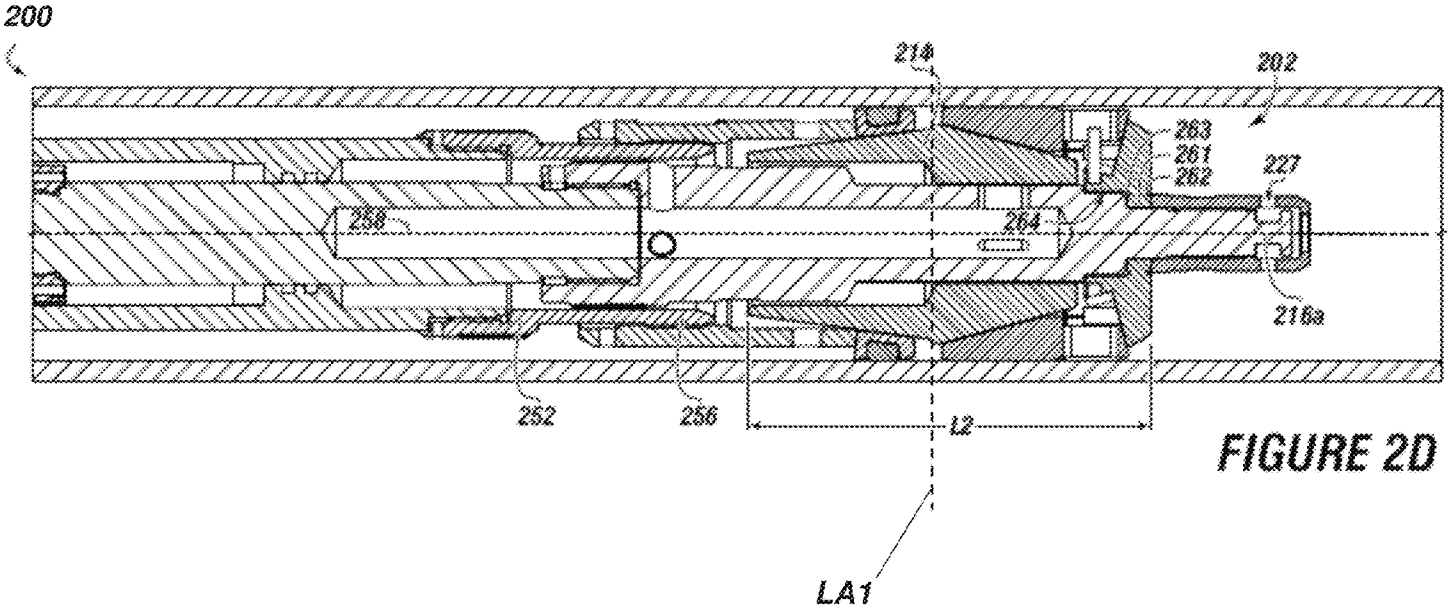
FIG. 2D shows a longitudinal side cross-sectional view of the downhole tool of FIG. 2C in a set position according to embodiments of the disclosure.
Figure 2E:
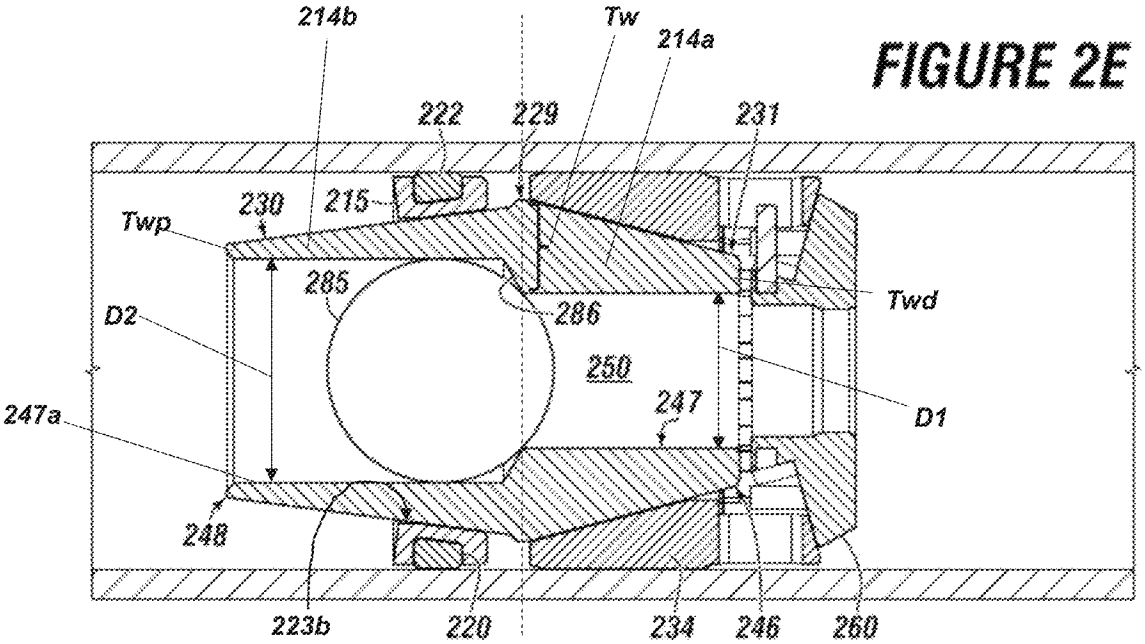
FIG. 2E shows a longitudinal side cross-sectional view of the downhole tool of FIG. 2C in a set position and disconnected from a workstring according to embodiments of the disclosure.

Referring now to FIGS. 2C, 2D, and 2E together, a longitudinal side cross-sectional view of a system having an unset downhole tool, a set downhole tool, and a set downhole tool disconnected from a workstring, respectively, according to embodiments of the disclosure, are shown. The setting device(s) and components of the downhole tool 202 may be coupled with, and axially and/or longitudinally movable, at least partially, with respect to each other.

The downhole tool 202 may include a cone mandrel 214 that extends through the tool 202 (or tool body). The cone mandrel 214 may be a solid body. In other aspects, the cone mandrel 214 may include a flowpath or bore 250 formed therein (e.g., an axial bore, inner flowbore, etc.). The bore 250 may extend partially or for a short distance through the cone mandrel 214. Alternatively, the bore 250 may extend through the entire mandrel 214, with an opening at its proximate end 248 and oppositely at its distal end 246 (near downhole end of the tool 202), as illustrated by FIG. 2E.

The presence of the bore 250 or other flowpath through the cone mandrel 214 may indirectly be dictated by operating conditions. That is, in most instances the tool 202 may be large enough in diameter (e.g., 4¾ inches) that the bore 250 may be correspondingly large enough (e.g., 1¼ inches) so that debris and junk may pass or flow through the bore 250 without plugging concerns.

With the presence of the bore 250, the cone mandrel 214 may have an inner bore surface 247, which may be smooth and annular in nature. In cross-section, the bore surface 247 may be planar. In embodiments, the bore surface 247 (in cross-section) may be parallel to a (central) tool axis 258. An outer mandrel surface 230 may have one or more surfaces (in cross-section) offset or angled to the tool axis 258.

The bore 250 (and thus the tool 202) may be configured for part of a setting tool assembly 217 to fit therein, such as a tension mandrel 216. Thus, the tension mandrel 216, which may be contemplated as being part of the setting tool assembly 217, may be configured for the downhole tool 202 (or components thereof) to be disposed therearound (such as during run-in). In assembly, the downhole tool 202 may be coupled with the setting tool assembly 217 (and around the tension mandrel 216), but not in a threaded manner. In an embodiment, the downhole tool 202 (by itself, and not including setting tool components) may be completely devoid of threaded connections. If used, an adapter 252 may include threads 256 thereon. Such threads 256 may correspond to mate with threads of the setting sleeve 254.

As shown, a lower sleeve 260 may be configured with a shear point, such as the shear tab 261. The shear tab 261 may be engaged with the setting tool assembly 217. As shown, the shear tab 261 may be engaged or proximate to each of the tension mandrel 216 and the nose nut 224. The lower sleeve 260 (or the shear point) may be configured to facilitate or promote deforming, and ultimately shearing/breaking, during setting. As such, the shear tab 261 may have at least one recess region or fracture groove 262 (tantamount to a predetermined and purposeful failure point of the lower sleeve 260).

The groove 262 may be circumferential around the tab 261. In embodiments the recess region 262 may be in the form of a v-notch or other shape or configuration suitable to allow the tab 261 to break free from the lower sleeve 260. The shear tab 261 may be configured to shear at a predetermined point. The shear tab 261 may be disposed within an inner lower sleeve bore 264, and protrude (or extend) radially inward in a circumferential manner. There may be other recessed regions 263. During setting, as the tension mandrel 216 continues to be pulled in direction A, the nut 224 will continue to exert force on the shear tab 261, ultimately resulting in shearing the tab. The shear tab 261 may be configured to shear at a load greater than the load for setting the tool 206.

The downhole tool 202 may be run into wellbore (206) to a desired depth or position by way of the workstring 212 that may be configured with the setting tool assembly 217. The workstring 212 and setting sleeve 254 may be part of the tool system 200 utilized to run the downhole tool 202 into the wellbore and activate the tool 202 to move from an unset to set position. The set position of the tool 202 (see FIG. 2E) may include a seal element 222 and/or slip 234 engaged with the tubular 208. In an embodiment, the setting sleeve 254 (that may be configured as part of the setting tool assembly) may be utilized to force or urge (directly or indirectly) expansion of the seal element 222 into sealing engagement with the surrounding tubular 208. The set position shown in 2E may include the downhole tool 202 engaged with the surrounding surface 207. The tension mandrel 216 may be disconnected from the downhole tool 202 and removed from the inner flowbore 250.

During run-in, an annulus 290 around the tool 202 may small or narrow enough that an undesirable pressure (or resistance) builds in front of the tool 202. As such, the tool 202 (in conjunction with the setting tool assembly 217) may provide a fluid (pressure) bypass flowpath 221. As shown in FIG. 2C, wellbore fluid Fw may enter a side (pin) window 245 of the slip 234, and then through a bottom side port 249*a* of the tension mandrel 216. The fluid Fw may exit from the tension mandrel 216 via upper side port 249*b*, and then out a setting sleeve side port 257 back into the annulus 290.

The setting device(s) and components of the downhole tool 202 may be coupled with, and axially and/or longitudinally movable along or in a working relationship with the cone mandrel 214. When the setting sequence begins, the lower sleeve 260 may be pulled via tension mandrel 216 while the setting sleeve 254 remains stationary.

As the tension mandrel 216 is pulled in the direction of Arrow A, one or more the components disposed about mandrel 214 between the distal end 246 and the proximate end 248 may begin to compress against one another as a result of the setting sleeve 254 (or end 255) held in place against carrier ring end surface 215. This force and resultant movement may urge the carrier ring 223 to compressively slide against an upper cone surface 230 of the cone mandrel 214, and ultimately expand (along with the seal element 222). Thus, the carrier ring 223 may be slidingly engaged with the cone mandrel 214.

As shown here by way of comparison in FIGS. 2C and 2E, whether the downhole tool 202 is in a set position or an unset position, an underside surface 223*b* of the carrier ring 223 may be entirely engaged with the outer surface 230. In the set position of 2E, the carrier ring 223 may be only in contact with the cone 214, and no other component of the downhole tool 202 (not including the optional seal element 222). Although not shown here, the carrier ring may be slidingly, sealingly engaged with the cone mandrel, such as via the use of one or more o-rings (which may be disposed in an o-ring groove on the underside of the cone mandrel).

One of skill would appreciate that the carrier ring 223 may be made of material suitable to achieve an amount of elongation necessary so that the seal element 222 disposed within the ring 223 may sealingly engage against the tubular 208. The amount of elongation may be in an elongation range of about 5% to about 25%-without fracture—as compared to an original size of the ring 223.

As the lower sleeve 260 is pulled further in the direction of Arrow A, the lower sleeve 260 (being engaged with the slip 234) may urge the slip 234 to compressively slide against a bottom cone surface 231 of the cone mandrel 214. As it is desirous for the slip 234 to fracture, the slip 234 need not have any elongation of significance. As fracture occurs, the slip (or segments thereof) 234 may also move radially outward into engagement with the surrounding tubular 208.

The slip 234 may have gripping elements, such as wickers, buttons, inserts or the like. In embodiments, the gripping elements may be serrated outer surfaces or teeth of the slip(s) may be configured such that the surfaces prevent the respective slip (or tool) from moving (e.g., axially or longitudinally) within the surrounding tubular 208, whereas otherwise the tool 202 may inadvertently release or move from its position.

From the drawings it would be apparent that the seal element 222 (or carrier ring 223) need not be in contact with the slip 234. Where the surfaces 230, 231 converge, there may be a crest or mandrel ridge 229. The crest 229 may be an outermost, central point of the cone mandrel 214. Thus, the crest 229 may have a crest wall thickness Tw corresponding to the widest (thickest) point of the mandrel 214. Notably the wall thickness Twd and/or Twp may be at its least point of thickness at the respective distal and proximate ends 246, 248.

As such, the crest wall thickness Tw at the crest 229 may be greater than either or both of the wall thickness Twd, Twp at the ends 246, 248. The crest 229 may beneficially limit any chance of undesirable extrusion, and may further prevent such contact between the slip 234 and the seal element 222. The Figures further illustrate that the slip 234 may be proximate to the first or distal end 246 of the cone mandrel 214, whereas the seal element 222 may be proximate to the second or proximate end 248 of the cone mandrel 214.

Because the sleeve 254 is held rigidly in place, the sleeve 254 may engage against load bearing end 215 of the carrier ring 223 that may result in at least partial transfer of load through the rest of the tool 202. The setting sleeve 254 may have a sleeve end 255 that abuts against the end 215. However, ring 223 will be urged against the cone mandrel 214 as the mandrel 214 is pulled.

The same effect, albeit in opposite direction may be felt by the slip 234. That is, the cone mandrel 214 may eventually reach a (near) stopping point, and the easiest degree of movement (and path of least resistance) is the slip 234 being urged by the lower sleeve 260 against the bottom cone surface 231. As a result, the slip 234 (or its segments) may urge outward and into engagement with the surrounding tubular 208.

In the event inserts (e.g., 378, FIG. 3A) are used, one or more may have an edge or corner suitable to provide additional bite into the tubular surface. In an embodiment, any of the inserts may be mild steel, such as 1018 heat treated steel, or other materials such as ceramic. Any insert may have a hole in it.

In an embodiment, slip 234 may be a one-piece slip, whereby the slip 234 has at least partial connectivity across its entire circumference. Meaning, while the slip 234 itself may have one or more grooves (or undulation, notch, etc.) configured therein, the slip 234 itself has no initial circumferential separation point. In an embodiment, the grooves of the slip may be equidistantly spaced or disposed therein.

The tool 202 may be configured with ball plug check valve assembly that includes a ball seat 286. The seat 286 may be removable or integrally formed therein. In an embodiment, the bore 250 of the cone mandrel 214 may be configured with the ball seat 286 formed or removably disposed therein. In some embodiments, the ball seat 286 may be integrally formed within the bore 250 of the cone mandrel 214. In other embodiments, the ball seat 286 may be separately or optionally installed within the cone mandrel 214, as may be desired. The ball seat 286 may be defined by inner bore 250 having a first inner diameter D1 smaller than a second inner diameter D2, as shown in FIG. 2C. Or put another way, there may be a first portion 214*a* of the cone mandrel 214 having a first inner surface 247 with the first inner diameter D1, and there may be a second portion 214*b* of the cone mandrel 214 having a second inner surface 247*a* with the second inner diameter D2.

The first inner surface 247 may have a constant inner diameter D1 from the ball seat 286 to the distal end 246. The second inner surface 247*a* may have a constant inner diameter D2 from the proximate end 248 to the ball seat. Regardless of the unset position (e.g., FIG. 2C) or the set position (e.g., FIG. 2D), a relative position of the ball seat 286 is disposed between the carrier ring 215 and the slip 234, as illustrated by a lateral axis reference LAI perpendicular to the long axis 258.

The ball seat 286 may be configured in a manner so that a ball 285 may seat or rest therein, whereby the flowpath through the cone mandrel 214 may be closed off (e.g., flow through the bore 250 is restricted or controlled by the presence of the ball). For example, fluid flow from one direction may urge and hold the ball against the seat 286, whereas fluid flow from the opposite direction may urge the ball off or away from the seat 286. As such, the ball may be used to prevent or otherwise control fluid flow through the tool 202. The ball may be conventionally made of a composite material, phenolic resin, etc., whereby the ball may be capable of holding maximum pressures experienced during downhole operations (e.g., fracing).

While not limited, a diameter of the ball 285 may be in in a ball diameter range of about 1 inch to about 5 inches. The bore 250 may have an inner bore diameter in a bore diameter range of about 1 inch to about 5 inches. As such, the cone mandrel 214 may have suitable wall thickness to handle load and prevent collapse.

The tool 202 may be configured as a drop ball plug, such that a drop ball may be flowed to the ball seat. The drop ball may be much larger diameter than the ball seat. In an embodiment, end 248 may be configured with the seat 286 such that the drop ball may come to rest and seat at in the seat 286 at the proximate end 248. As applicable, the drop ball 285 may be lowered into the wellbore and flowed toward the seat 286 formed within the tool 202.

The drop ball (or "frac ball") may be any type of ball apparent to one of skill in the art and suitable for use with embodiments disclosed herein. Although nomenclature of 'drop' or 'frac' ball is used, any such ball may be a ball held in place or otherwise positioned within a downhole tool. The ball may be tethered to the tool 202 (or any component thereof). The tethered ball may be as provided for in U.S. Non-Provisional patent application Ser. No. 16/387,985, filed Apr. 18, 2019, and incorporated herein by reference in its entirety for all purposes, including as it pertains to a tethered ball.

The ball may be a "smart" ball (not shown here) configured to monitor or measure downhole conditions, and otherwise convey information back to the surface or an operator, such as the ball(s) provided by Aquanetus Technology, Inc. or OpenField Technology.

In other aspects, the ball 285 may be made from a composite material. In an embodiment, the composite material may be wound filament. Other materials are possible, such as glass or carbon fibers, phenolic material, plastics, fiberglass composite (sheets), plastic, etc.

The drop ball 285 may be made from a dissolvable material, such as that as disclosed in U.S. patent application Ser. No. 15/784,020, and incorporated herein by reference as it pertains to dissolvable materials. The ball may be configured or otherwise designed to dissolve under certain conditions or various parameters, including those related to temperature, pressure, and composition.

Although not shown here, the downhole tool 202 may have a pumpdown ring or other suitable structure to facilitate or enhance run-in. The downhole tool 202 may have a 'composite member' like that described in U.S. Pat. No. 8,955,605, incorporated by reference herein in its entirety for all purposes, particularly as it pertains to the composite member.

In other aspects, the tool 202 may be configured as a bridge plug, which once set in the wellbore, may prevent or allow flow in either direction (e.g., upwardly/downwardly, etc.) through tool 202. Accordingly, it should be apparent to one of skill in the art that the tool 202 of the present disclosure may be configurable as a frac plug, a drop ball plug, bridge plug, etc. simply by utilizing one of a plurality of adapters or other optional components. In any configuration, once the tool 202 is properly set, fluid pressure may be increased in the wellbore, such that further downhole operations, such as fracture in a target zone, may commence.

The tool 202 may include an anti-rotation assembly that includes an anti-rotation device or mechanism, which may be a spring, a mechanically spring-energized composite tubular member, and so forth. The device may be configured and usable for the prevention of undesired or inadvertent movement or unwinding of the tool 202 components.

The anti-rotation mechanism may provide additional safety for the tool and operators in the sense it may help prevent inoperability of tool in situations where the tool is inadvertently used in the wrong application. For example, if the tool is used in the wrong temperature application, components of the tool may be prone to melt, whereby the device and lock ring may aid in keeping the rest of the tool together. As such, the device may prevent tool components from loosening and/or unscrewing, as well as prevent tool 202 unscrewing or falling off the workstring 212.

Of great significance, the downhole tool 202 may have an assembled, unset length L1 of less than about 6 inches. In embodiments the downhole tool 202 may have a length L1 in a range of about 3.5 inches to about 15 inches. As a result of the setting sequence, the set downhole tool 202 may have a set length L2 that is less than the length L1.

One of skill would appreciate that in an assembled configuration and not connected with a setting tool 217, one or more components of the tool 202 may be susceptible to falling free from the tool. As such, one or more components may be bonded (such as with a glue) to another in order to give the tool 202 an ability to hold together without the presence of the setting tool. Any such bond need not be of any great strength. In embodiments, the components of the tool 202 may be snugly press fit together.

The surfaces 230, 231 of the cone mandrel 214 may be generally planar. Thus, the first outer cone surface 230 and the second outer cone surface 231 may have respective reference planes. The planes (and the outer surfaces 230, 231) may be offset from a long axis 258 of the tool 202 (or respective longitudinal axis or reference planes) by a respective angle(s).

That is, one plane may bisect the long axis 258 at the angle a1, and another plane may bisect the long axis 258. The respective angles may be equal and/or opposite to another. For example, the second angle may be negative to the first angle (e.g., +10 degrees for the first, −10 degrees for the second), and thus providing the 'dual' cone shape of the mandrel 214. The cone mandrel 214 may have outer surfaces 230, 231 that are void of threads or threading.

Angles of the cone mandrel surface(s) described herein may be negative to that of others, with one of skill understanding a positive or negative angle is not of consequence, and instead is only based on a reference point. An angle may be an 'absolute' angle is meant refer to angles in the same magnitude of degree, and not necessarily of direction or orientation.

Referring now to FIGS. 3A, 3B, 3C, and 3D together, a longitudinal side cross-sectional view of a downhole tool, a longitudinal side cross-sectional view of a mandrel for a downhole tool, a close up side cross-sectional view of a ball engaged in a ball seat, and a close-up side cross-sectional view of a ball seat, respectively, in accordance with embodiments disclosed herein, are shown.

FIGS. 3A-3D together show a downhole tool 302 may be run, set, and operated as described herein and in other embodiments (such as in system 200, 300, etc. and so forth), and as otherwise understood to one of skill in the art. The downhole tool 302 may be in a set and disconnected configuration (such as that shown in FIG. 3A). Components of the downhole tool 302 may be arranged and disposed about a mandrel 314, as described herein and in other embodiments, and as otherwise understood to one of skill in the art.

Thus, downhole tool 302 may be comparable or identical in aspects, function, operation, components, etc. as that of other tool embodiments disclosed herein (e.g., 202). Similarities may not be discussed for the sake of brevity. Just the same, it is within the scope of the disclosure that the downhole tool 302 may be another type of downhole tool other than that shown by way of example. The downhole tool 302 may be top set or bottom set, depending on configuration.

The downhole tool 302 may have one or more components, such as a first or bottom slip 334 and a second or top slip 335, which may be made of a material as described herein and in accordance with embodiments of the disclosure. Such materials may include composite material, such as filament wound material, reactive material (metals or composites), and so forth. Filament wound material may provide advantages to that of other composite-type materials, and thus be desired over that of injection molded materials and the like. Other materials for the tool 502 (or any of its components) may include dissolving thermoplastics, such as PGA, PLL, and PLA.

One of skill would appreciate that in an assembled (or run-in) configuration and not connected with a setting tool (217), one or more components of the tool 302 may be susceptible to falling free from the tool. As such, one or more components may be bonded (such as with a glue) to another in order to give the tool 302 an ability to hold together without the presence of the setting tool. Any such bond need not be of any great strength. In embodiments, the components of the tool 302 may be snugly press fit together.

The mandrel 314 may extend at least partially through the tool (or tool body) 302 in the sense that components may be disposed therearound. The mandrel 314 may include a flowpath or bore 350 formed therein (e.g., an axial bore), which may correspond a bore of the tool 302. The bore 350 may extend partially or for a short distance through the mandrel 314. Alternatively, the bore 350 may extend through the entire mandrel 314, with an opening at its proximate end 348 and oppositely at its distal end 346. The bore 350 may be configured to accommodate a setting tool (or component thereof, e.g., 216, FIG. 2D) fitting therein.

The downhole tool 302 may include a seal element 322, which may be made of an elastomeric and/or poly material, such as rubber, dissolvable rubber, nitrile rubber, Viton or polyurethane. In an embodiment, the seal element 322 may be made from 75 to 80 Duro A elastomer material. The seal element 322 may be configured to expand and elongate a radial manner, into sealing engagement with the surrounding tubular 308 upon compression of the tool components (e.g., during setting). Accordingly, the seal element 322 may provide a fluid-tight seal of the seal surface against the tubular.

The downhole tool 302 may have the first slip 334 disposed around or engaged with a composite member 320, like that described in U.S. Pat. No. 8,955,605, incorporated by reference herein in its entirety for all purposes, particularly as it pertains to the composite member. The composite member 320 may be configured in such a manner that upon a compressive force, at least a portion of the composite member may begin to deform (or expand, deflect, twist, unspring, break, unwind, etc.) in a radial direction away from the tool axis.

During pump down (or run in), the composite member 320 may 'flower' or be energized as a result of a pumped fluid, resulting in greater run-in efficiency (less time, less fluid required). During the setting sequence, the seal element 322 and the composite member 320 may compress together.

The slip 334 may be a one-piece slip, whereby the slip 334 has at least partial connectivity across its entire circumference. Meaning, while the slip 334 itself may have one or more grooves 344 configured therein, the slip 334 need not be multi-segment with an at least one separation point in the pre-set configuration.

The slip 334 may include a feature for gripping the inner wall of a tubular, casing, and/or well bore, such as a plurality of gripping elements, including serrations or teeth, inserts 375, etc.

The slip 334 may be used to lock the tool 302 in place during the setting process by holding potential energy of compressed components in place. The slip 334 may also prevent the tool 302 from moving as a result of fluid pressure against the tool.

The downhole tool 302 (or its mandrel 314) may have a ball seat 386 configured or arranged for a ball or other type of plug 385 to seat and reside therein (for example, during a pressurization sequence or operation). In aspects, the ball seat 386 may be in the proximate end 348 of the mandrel 314.

The inner bore 350 of the mandrel 314 may be contemplated as having a first portion 314*a* and a second portion 314*b*, with the ball seat 376 therebetween. The first portion 314*a* may have a first inner diameter D1. The second portion 314*b* may have a second inner diameter D2. The first inner diameter D1 may be smaller than the second inner D2. The first inner diameter may be constant along the portion 314*a*. The ball seat 386 may be configured with a radial seat surface 332 having a radial R2. The first inner diameter D1 may extend from an end 332*a* of the radial seat surface all the way to a furthest end 346*a* of the distal end 346. As shown here, the first inner diameter D1 may be constant between the end 332*a* and a bevel or taper 374 (of the bore 350 at the distal end 346).

Figure 3A:
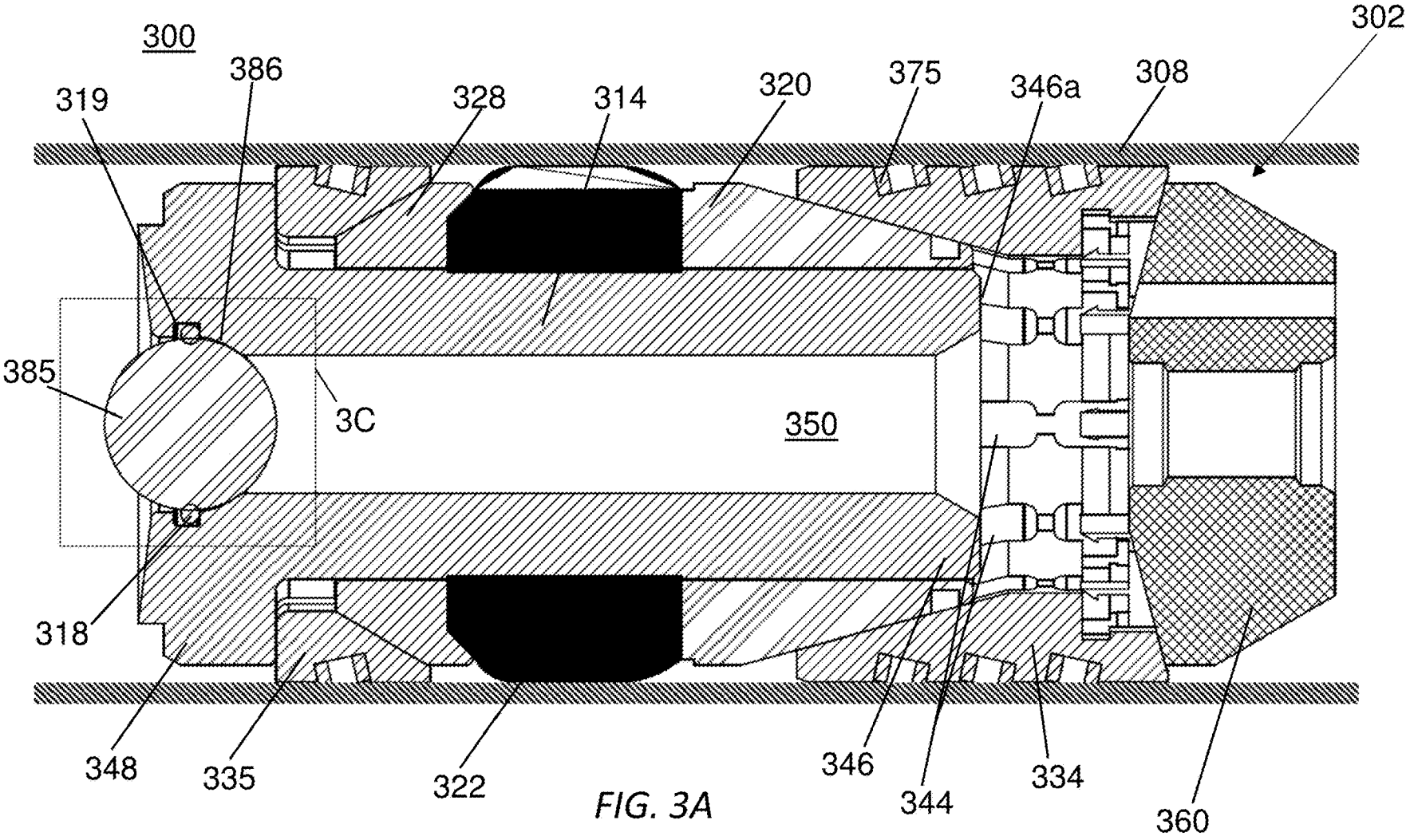
FIG. 3A shows a longitudinal side cross-sectional view of a downhole tool during a pressurization sequence according to embodiments of the disclosure.
Figure 3B:
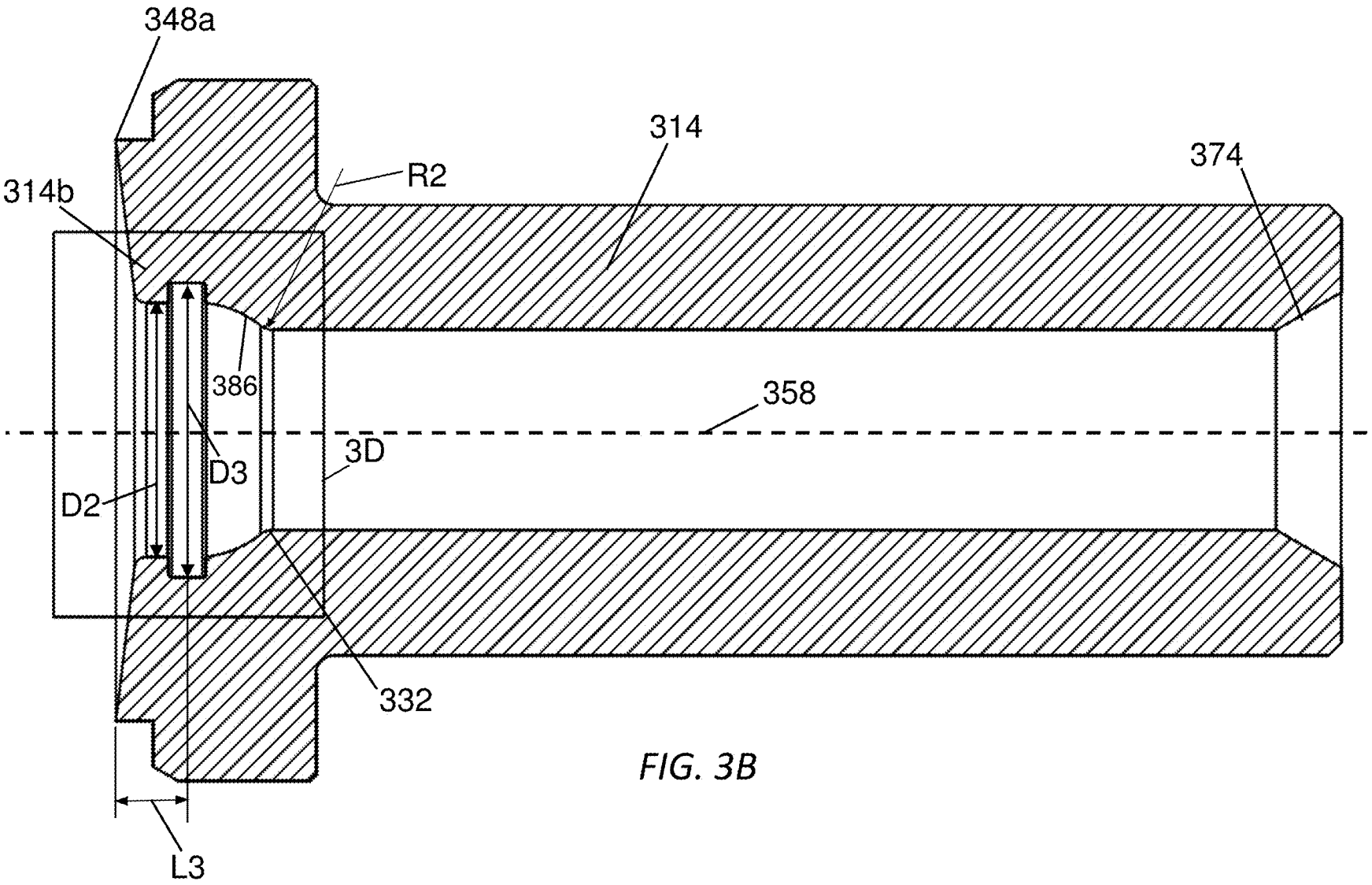
FIG. 3B shows a longitudinal side cross-sectional view of a mandrel configured with a ball seat according to embodiments of the disclosure.
Figure 3C:
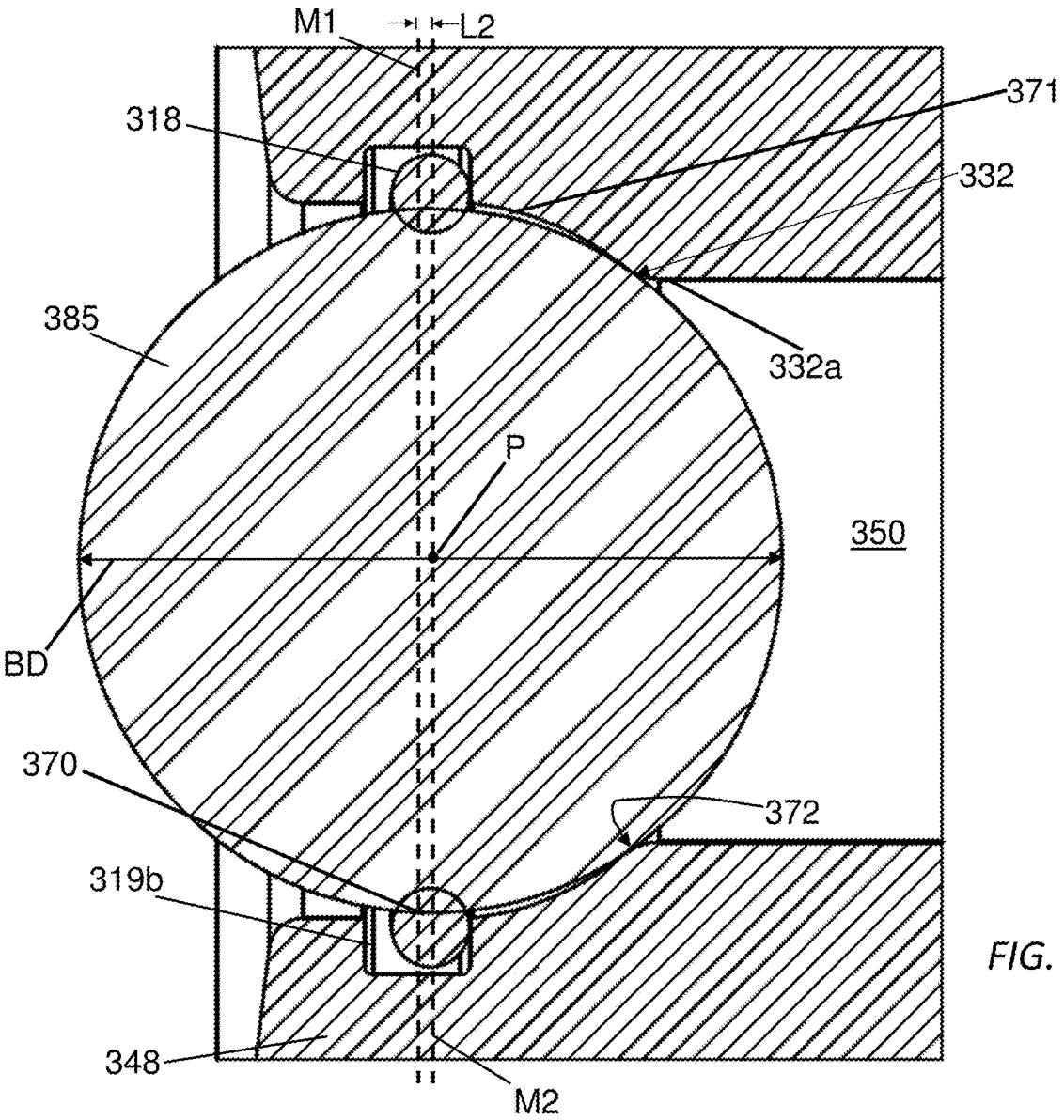
FIG. 3C shows a close up side cross-sectional view of the downhole tool of FIG. 3A with a ball engaged in the ball seat according to embodiments of the disclosure.
Figure 3D:
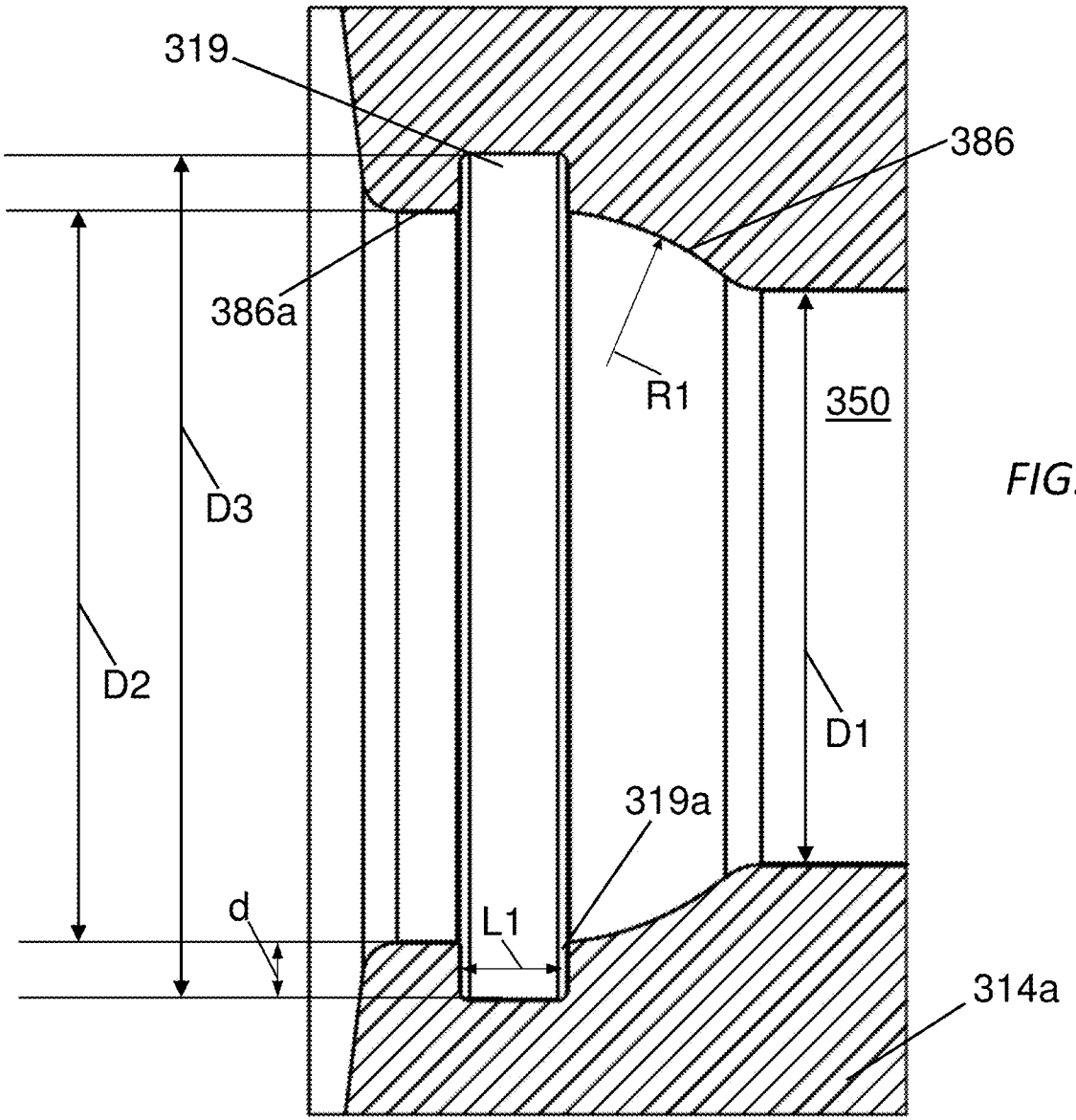
FIG. 3D shows a close-up side cross-sectional view of the ball seat of FIG. 3B according to embodiments of the disclosure.

FIGS. 3B-3D together show the ball seat 386 configuration may include a range or specific nominal geometry associated therewith. For example, a ball seat groove (recess, etc.) 319 may be formed with (generally) linear edging with a depth d in a depth range of about 0.1 inches to about 0.4 inches. The depth range may be about 0.2 inches to about 0.3 inches. The depth d may result in the groove 319 having an inner groove diameter D3 of about 1 inch to about 2 inches. The inner groove diameter D3 may be between about 1.3 inches to about 1.4 inches.

The ball seat groove 319 may have a length L1 (with respect to reference axis 358) in a range of about 0.05 inches to about 0.3 inches. In an embodiment, the length of L1 may be about 0.1 inch to about 0.3 inches. For example, about 0.18 inches to about 0.19 inches.

The ball seat surface 386 may be curvilinear in nature, and extend from a bottom shoulder surface 319*a* to the radial seat surface 332. The ball seat surface 386 may be associated with a (inner) radius R1. Thus, the ball seat 386 may have one or both of a convex and a concave portion. The upper shoulder surface 319*b* may lead into a linear seat surface 386*a*. The radial seat surface 332 may be associated with the radius R2.

There may be a compressible member 318 disposed in the groove 319. The compressible member 318 may be made of a durable rubber, nitrile, degradable material, and the like. The member 318 may be an O-ring or other suitable device. For example, the compressible member 318 may be a 200-series O-ring.

The length L1 of the groove may have a midpoint M1. The compressible member 318 may have a member midpoint M2 (akin to a radius of a diameter, although the compressible member may compress). The midpoint M1 may be disposed about a length L3 from a furthermost end 348*a* of the proximate end 348. The length L3 may have a range of about 0.1 inch to about 0.9 inches. In embodiments, the length L3 may be about 0.3 inches to about 0.4 inches.

In some instances, such as during a pressurization sequence, the midpoint M1 and the member midpoint M2 may have a subtle offset length L2, such as about 0.01 inches to about 0.05 inches. In embodiments, the offset length L2 may be about 0.02 inches to about 0.03 inches. The offset length L2 facilitates a desired amount of squeeze (e.g., maximum) that may be achieved at the full ball diameter BD (seen by intersect by a lateral at point P) when sufficient pressure is applied from a top (uphole) side of the ball 385.

This may result in causing the compressible member 318 to shift to the bottom (downhole) shoulder 319*a* of the groove 319, as shown in FIG. 3C. In addition to this the inner groove diameter that the ball 385 enters is larger than the nominal ball diameter BD to ensure that the ball 385 may be reliably installed into the seat 386 by pressure and flow alone after the tool 302 has been set downhole.

The ball seat radius R1 that begins below shoulder 319*a* may be smaller than the radius of the ball 385, which may ensure that the point of metal-to-metal contact at the bottom of the seat is between the secondary radius (entering the mandrel ID) and the ball OD, as shown in 3C.

The downhole tool 302 may be used during a pressurization sequence. In use, the downhole tool 302 may be in a set position or configuration (e.g., as depicted in FIG. 3A). In the set position, the downhole tool 302 may be disconnected from a workstring. The pressurization may include a moment of time when the ball 385 is directed into the wellbore 308 and toward the tool 302, such as via pumping, dropped/gravity, and so forth. The ball 385 may eventually come into proximity of the tool 302.

This may result in the compressible member 318 moving (shifting) in response to uphole pressure. For example, the compressible member 318 may shift toward the downhole side 319*a* of the groove 319. In embodiments, this may result in centered alignment of the compressible member 318 and the ball 385 (see, e.g., FIG. 3C). This may occur expediently once the ball 385 is moved against the seat 386 and/or compressible member 318.

Since the diameter of the ball BD may interferes with the unstretched ID of the compressible member 318, just the act of pressing or urging the ball 385 into the seat 386 may be sufficient to shift the member 318. With additional or increased (hydraulic/fluid) pressure, the member 318 may continue to shift. In aspects, the pressurization sequence may utilize a pressure range of about 1 psi to about 100 psi to sufficiently seat the ball 385.

During pressurization, the ball 385 may experience a first contact point 370 and a second contact point 372 within proximity of the seat 386. There may be a space or region between the contact points 370, 372, shown here as a convergence gap 371. In normal scaling with a compressible member, there may not be any convergence between respective surfaces. In contrast, the sealing of the compressible member 318 to form the first contact point 370 may result in the convergence of surfaces (in this case, a [curvilinear] portion of the ball seat 386 against the ball 385). Thus, while the ball 385 is seated, there may be at all times a point of non-contact between the ball 385 and the seat 386.

Advantages.

Embodiments herein may advantageously allow for downhole tool to have a reliable seal between a ball seat and ball even after significant corrosion due to temperature and/or chloride composition of the fluid. This resultantly may increase the amount of time available for the downhole tool to be run in hole, set, and have differential pressure applied to it, thereby increasing the overall effectiveness of the tool along with reliability.

While preferred embodiments of the disclosure have been shown and described, modifications thereof can be made by one skilled in the art without departing from the spirit and teachings of the disclosure. The embodiments described herein are exemplary only, and are not intended to be limiting. Many variations and modifications of the disclosure disclosed herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. A downhole tool for use in a wellbore, the downhole tool comprising:

a mandrel comprising:

a distal end; a proximate end having a furthermost end; an outer surface; an inner flowbore extending therethrough from the proximate end to the distal end; a ball seat in the inner flowbore; a ball seat groove formed in the inner flowbore between the furthermost end and the ball seat; and a compressible member disposed in the ball seat groove, a first slip disposed around the mandrel;

a first cone disposed around the mandrel; and a sealing element disposed around the mandrel;

wherein the ball seat comprises a seat portion that results in a first inner diameter of a first portion of the inner flowbore differentiated in a size from a second inner diameter of a second portion of the inner flowbore, wherein a ball is positioned within the ball seat in a manner to form a first contact point against the ball from the compressible member, and also a second contact point against the ball directly from the ball seat, wherein on a first lateral reference, the ball seat groove comprises a groove midpoint, wherein on a second lateral reference, the ball has a ball midpoint, wherein during a pressurization sequence, the groove midpoint is offset from the ball midpoint, and wherein a convergence gap is formed between the first contact point and the second contact point.

2. The downhole tool of claim 1, wherein the downhole tool is movable from a run-in configuration to a set configuration, and wherein the pressurization sequence occurs when the downhole tool is in the set configuration.

3. The downhole tool of claim 2, wherein a longitudinal length of distance between the groove midpoint and the furthermost end is in a length range of at least 0.1 inches to no more than 0.9 inches.

4. The downhole tool of claim 3, wherein the compressible member comprises an o-ring.

5. The downhole tool of claim 4, wherein the convergence gap is formed between a surface of the ball and a curvilinear portion of the ball seat that, the curvilinear portion ending at a radial seat surface having a radial.

6. The downhole tool of claim 1, wherein the compressible member comprises an o-ring.

7. A downhole tool for use in a wellbore, the downhole tool comprising:

a mandrel comprising:

a distal end; a proximate end; an outer surface; an inner flowbore extending therethrough from the proximate end to the distal end; a ball seat in the inner flowbore, and a ball seat groove formed in the inner flowbore proximate the ball seat; and a compressible member disposed in the ball seat groove, a first slip disposed around the mandrel;

a first cone disposed around the mandrel; and a sealing element disposed around the mandrel;

wherein the outer surface of the mandrel is void of threads, and wherein the ball seat comprises a transition portion that results in a first inner diameter of a first portion of the inner flowbore differentiated in a size from a second inner diameter of a second portion of the inner flowbore, and wherein a ball is configured to be positioned within the ball seat in contact with the compressible member.

8. The downhole tool of claim 7, wherein on a first lateral reference, the ball seat groove comprises a groove midpoint, wherein on a second lateral reference, the ball has a ball midpoint, and wherein during a pressurization sequence, the groove midpoint is offset from the ball midpoint.

9. The downhole tool of claim 8, wherein the proximate end further comprises a furthermost end, wherein the first inner diameter is smaller than the second inner diameter, and wherein the first inner diameter of the first portion between a lower end of the ball seat and the distal end is constant.

10. The downhole tool of claim 9, wherein any component of the downhole tool is made of a dissolvable metal-based material, and wherein a longitudinal length of distance between the groove midpoint and the furthermost end is in a length range of at least 0.1 inches to no more than 0.9 inches.

11. The downhole tool of claim 10, wherein the downhole tool is movable from a run-in configuration to a set configuration, and wherein the pressurization sequence occurs when the downhole tool is in the set configuration.

12. The downhole tool of claim 7, wherein a ball is positioned within the ball seat in a manner to form a first contact point against the ball, but not from the ball seat, and also a second contact point against the ball directly from the ball seat, and wherein a convergence gap is formed between the first contact point and the second contact point, and also formed between a surface of the ball and a curvilinear portion of the ball seat, the curvilinear portion ending at a radial seat surface having a radial.

13. The downhole tool of claim 12, wherein the downhole tool further comprises a lower sleeve coupled with the first slip, wherein at least one of the lower sleeve, the first slip, and combinations thereof, are engaged with the mandrel in an unset position, and wherein the compressible member comprises an o-ring.

14. The downhole tool of claim 13, wherein on a first lateral reference, the groove comprises a groove midpoint, wherein on a second lateral reference, the ball has a ball midpoint, and wherein during a pressurization sequence, the groove midpoint is offset from the ball midpoint.

15. A downhole tool for use in a wellbore, the downhole tool comprising:

a mandrel comprising:

a distal end; a proximate end having a furthermost end; an outer surface; an inner flowbore extending through the mandrel from the proximate end to the distal end; a ball seat in the inner flowbore; a ball seat groove formed in the inner flowbore between the furthermost end and the ball seat; and a compressible member disposed in the ball seat groove, a first slip disposed around the mandrel;

a lower sleeve coupled with the first slip;

a first cone disposed around the mandrel; and a sealing element disposed around the mandrel, wherein a ball is configured to be positioned within the ball seat wherein on a first lateral reference, the ball seat groove comprises a groove midpoint, wherein on a second lateral reference, the ball has a ball midpoint, wherein during a pressurization sequence, the groove midpoint is offset from the ball midpoint wherein the downhole tool is movable from a run-in configuration to a set configuration, and wherein the pressurization sequence occurs when the downhole tool is in the set configuration.

16. The downhole tool of claim 15, wherein any component of the downhole tool is made of a dissolvable metal-based material.

17. The downhole tool of claim 16, wherein at least one of the lower sleeve, the slip, and combinations thereof, are engaged with the mandrel in the run-in configuration, and wherein a longitudinal length of the downhole tool after being moved to the set configuration is in a set length range of at least 5 inches to no more than 15 inches.

18. The downhole tool of claim 17, wherein the outer surface of the mandrel is void of threads.

19. The downhole tool of claim 18, wherein the ball seat is defined by a first portion of the inner flowbore having a first inner diameter smaller than another portion of the inner flowbore having a second inner diameter, and wherein the first inner diameter of the first portion between the ball seat and the distal end is constant.

20. A downhole tool of claim 19, wherein for at least a portion of time during the pressurization sequence, the compressible member engages a ball as the ball seats thereagainst, and at the same time the ball also engages the mandrel at a contact point, with a convergence gap formed therebetween.

* * * * *